US005450499A

United States Patent [19]

Morris, Sr. et al.

[11] Patent Number: 5,450,499

[45] Date of Patent: Sep. 12, 1995

[54] AUDIO SPEAKER FOR USE IN AN EXTERNAL MAGNETIC FIELD

[75] Inventors: G. Ronald Morris, Sr.; G. Ronald Morris, Jr., both of Bay Shore, N.Y.; Charles E. McMillen, Versailles, Ky.

[73] Assignee: Magnetic Resonance Equipment Corporation, Wilmington, Del.

[21] Appl. No.: 982,285

[22] Filed: Nov. 25, 1992

[51] Int. Cl.[6] ..... H04R 25/00

[52] U.S. Cl. ..... 381/192; 381/194; 381/205

[58] Field of Search ..... 381/192, 199, 194, 195, 381/197, 190, 201, 169, 188, 205; 324/309, 318

[56] References Cited

U.S. PATENT DOCUMENTS

| | | | |
|---|---|---|---|
| 3,548,116 | 12/1970 | Schafft . | |
| 4,190,784 | 2/1980 | Massa . | |
| 4,427,845 | 1/1984 | Yoshida . | |
| 4,458,170 | 4/1984 | Takayama et al. . | |
| 4,565,905 | 1/1986 | Nation | 381/193 |
| 4,597,100 | 6/1986 | Grodinsky et al. . | |
| 4,696,030 | 9/1987 | Egozi . | |
| 4,701,952 | 10/1987 | Taylor . | |
| 4,878,499 | 11/1989 | Suzuki et al. | 324/309 |
| 4,879,514 | 11/1989 | Mehlkopf et al. . | |
| 4,903,703 | 2/1990 | Igarashi et al. | 381/169 |
| 4,905,272 | 2/1990 | Van de Mortel et al. . | |
| 4,933,975 | 6/1990 | Button | 381/192 |
| 4,933,981 | 6/1990 | Lederer . | |
| 5,022,405 | 6/1991 | Hök et al. . | |

FOREIGN PATENT DOCUMENTS

| | | | |
|---|---|---|---|
| 0486254 | 5/1992 | European Pat. Off. | 381/199 |
| 0079200 | 4/1991 | Japan | 381/199 |
| 3-88498 | 4/1991 | Japan | 381/199 |

*Primary Examiner*—Curtis Kuntz
*Assistant Examiner*—Huyen D. Le
*Attorney, Agent, or Firm*—Amster, Rothstein & Ebenstein

[57] ABSTRACT

An electrodynamic loudspeaker for use in a magnetic field generated by an external source, the speaker comprising an acoustic diaphragm attachable to a non-magnetic speaker frame at one end thereof; and a voice coil wound on a bobbin attached to the opposite end thereof, the speaker frame being adapted for mounting the speaker within the external field, the speaker further comprising a magnetic field diverter for locally reshaping the external field in the area of the voice coil for improved efficiency, and including provisions for effectuating operation of the speaker in external fields which may be oriented at various angles relative to the longitudinal extent of the diaphragm.

13 Claims, 5 Drawing Sheets

AUDIO SPEAKER FOR USE IN AN EXTERNAL MAGNETIC FIELD

BACKGROUND OF THE INVENTION

1. Field of the Invention

The present invention relates to the generation of acoustic waves from electronic signals to provide audible sounds, and more particularly, to a speaker apparatus which utilizes the interaction between a current carrying conductor and a magnetic field generated external to the speaker apparatus, to drive a speaker cone.

2. Description of the Prior Art

Modern music systems convert electronic signals from an audio amplifier to sounds using a conventional electrodynamic loudspeaker. While such loudspeakers are readily available, relatively inexpensive and operate well in most home and business environments, they are ineffective in environments in which large magnetic fields are present.

Conventional loudspeakers employ a permanent magnet and cone which are rigidly attached to a speaker frame. The cone typically has a voice coil attached, which together with the permanent magnet, make up the driver of the speaker. The voice coil comprises a plurality of turns of fine wire wound on a bobbin. When electrical signals from an audio amplifier are applied to the voice coil, the magnetic field from the internal permanent magnet interacts with the current in the coil windings, thereby causing a force to be applied to the voice coil/bobbin assembly. Since the speaker magnet is fixed in the frame, the voice coil/bobbin assembly moves due to this applied force. As a result, the cone vibrates at a given amplitude and frequency in proportion to the applied current.

In the presence of a large external magnetic field, a conventional loudspeaker will not function properly. The external field interacts with the permanent magnet as well as with the magnetizable material usually employed in construction of the speaker frame and magnet support structure. As a result, the net magnetic field at the voice coil will be inconsistent with normal operating and design parameters. An external field can alter both the magnitude and direction of the net field at the voice coil windings, thus contributing to ineffective cone vibrations in response to electrical signals from the amplifier. Furthermore, if the speaker is removed from the external field, permanent damage to the speaker magnet and support structure can result.

One remedy is to construct the speaker entirely of non-magnetic components which are unaffected by the presence of a strong external magnetic field. In U.S. Pat. No. 4,933,981, issued to Lederer, an electromagnetically shielded sound system adapted for operation in conjunction with a magnetic resonance imaging apparatus is disclosed, which employs separate high and low frequency piezoelectric crystalline transducers which mechanically vibrate in response to applied electrical signals, thereby producing audible sounds which are communicated to a patient by a pair of elongated pneumatic wave guide tubes. Another example of a speaker utilizing piezoelectric transducers is taught in U.S. Pat. No. 4,190,784, issued to Massa.

Strong external magnetic fields also pose safety concerns when placing objects composed of magnetic material in close proximity. Magnetic material experiences a rotational torque proportional to the local magnetic field strength and a linear force of attraction proportional to the local magnetic field gradient. Therefore, objects containing large amounts of magnetic material can rotate to align themselves with the field and be projected like missiles toward the strongest portion thereof. To counter this undesirable tendency, it is necessary to rigidly fix magnetic objects in place, often with inefficient structures which add weight and complexity.

One application where loudspeakers are operated in the presence of large external fields is in magnetic resonance ("MR") examinations. Since the patient is required to lay down within a large bore in the device for often extended periods of time, it is desirable to communicate with and/or provide sound to such a patient. During an MR examination, a strong magnetic field is generated and varying RF fields are reradiated and processed by a microprocessor. Since the magnetic field distribution must be uniform to a few parts per million over the imaging volume, objects located around the magnet in the fringe magnetic field, such as a conventional loudspeaker containing a large amount of magnetic material, can degrade the uniformity of the external field and cause inaccuracies in system operation.

In the past, communication and music have been provided to patients undergoing MR by using either magnetic transducers positioned outside the fringe field of the magnet such as that taught in U.S. Pat. No. 4,701,952, issued to Taylor, or non-magnetic piezoelectric transducers located near the magnet as in the Lederer apparatus. These prior art systems have shortcomings. The remote speaker location requires that the generated sounds be typically delivered to the patient using non-magnetic wave guide tubing. However, since the sound quality is best when the length of the tubing is short, it is desirable to locate the transducer near the magnet. Since conventional speakers are rendered inoperable in such an environment, and because magnetically inert transducers do not provide uniform frequency response, it is usually necessary to employ multiple transducers in combination with expensive frequency equalizing electronics. Moreover, such transducers are not readily usable with commercial audio amplifiers, necessitating the use of expensive, custom components.

During MR examinations, loud sounds are produced by activation of the gradient fields produced by the MR apparatus. The sound intensity can be very high depending on the type of examination, and the field strength of the MR system. In the past, noise cancellation techniques have been employed to reduce or remove such sounds, an example of which is taught in U.S. Pat. No. 4,696,030, issued to Engozi. These techniques have typically utilized conventional loudspeakers displaced far from the MR magnets to generate sound waves 180 degrees out of phase with the noise. These out-of-phase sounds are combined with gradient sounds when delivered to the patient through wave guide tubes attached to headphones. Consequently, the patient hears sounds which, through phase cancellation, are of much lower intensity then the gradient sounds the patient would otherwise hear during examination. If an efficient loudspeaker were available which could operate within a strong magnetic field, in addition to providing the benefits of communication and music, it could be suitable for use in such noise cancellation systems.

SUMMARY OF THE INVENTION

In light of the above described shortcomings associated with prior art designs, there is a need for an electrodynamic audio speaker which can operate in the presence of a strong magnetic field, which does not require a permanent, internal magnet for operation.

Accordingly, it is an object of the present invention to provide an electrodynamic audio loudspeaker for use in a strong magnetic field, such as produced by an MR system for medical diagnosis, to communicate and/or provide music to a patient undergoing diagnostic examination.

It is another object of the instant invention to provide a loudspeaker with improved efficiency for use in a strong magnetic field generator external to the loudspeaker.

It is still another object of the present invention to provide a loudspeaker which can be used safely in such a field without risk of damaging equipment or injuring personnel.

It is yet another object of the invention to provide a loudspeaker which can be used within, and yet have minimal impact on, the homogeneity of such a field.

In accordance with the present invention, there is provided an electrodynamic loudspeaker for use in an external magnetic field, generally comprised of an acoustic diaphragm attached to a non-magnetic frame at one end thereof, and a voice coil wound on a bobbin attached to the opposite end thereof. The voice coil is typically comprised of a plurality of coil windings as is well known in the art of speaker design, and electrically communicates with an external amplification source. Current is directed through the coil at certain amplitude and frequency levels. The external field interacts with the varying current in the coil to produce a resultant load on the bobbin and attached diaphragm, which causes the diaphragm to oscillate relative to the frame, thereby producing acoustic pressure waves in the audible range. Since operation is dependent upon the existence of the external field, the magnetic interference problems associated with prior art devices is avoided. Moreover, because magnetically driven speakers have vastly superior frequency response to those with piezoelectric transducers, sound quality is improved without the need for additional complex speaker customized electronics or construction.

To improve performance, a field diverter fabricated from ferromagnetic material with high magnetic permeability can be disposed within the bobbin and rigidly attached to the frame. The field diverter reshapes the external magnetic field in the area proximal to the bobbin to provide a radial field component orthogonal to the coil windings to improve efficiency and maintain proper field orientation, even if the speaker is rotated through angles which would otherwise minimize radial field components across the coil.

Additional variations in the geometrical shape of the field diverter may lead to improved performance, however generally at the expense of increased complexity. As an example, a diverter configured to form a gap for the bobbin and windings can provide increased field strength and therefore increased force. Additional improvements can be obtained by fabricating the bobbin to dissipate heat generated by the conductive windings. In this case, it is desirable to construct the bobbin from material with good thermal conductivity such as aluminum, copper or equivalent. Aluminum, which is lightweight, is a preferred material. Fins or other structures can be incorporated to increase heat dissipation from the bobbin to the ambient environment.

If the speaker assembly is to be oriented within the external field with the longitudinal extent of the diaphragm generally perpendicular to the field lines thereof, it may be necessary to magnetically shield a portion of the coil windings at one end of the bobbin so that unequal loads are imposed thereon to effectuate vibration. Without this partial shielding, equal and opposite forces may be produced which subject the bobbin to a rotational torque, but result in zero axial displacement, thereby preventing proper oscillation of the acoustic diaphragm relative to the frame. To alleviate this problem, in one embodiment, a rectangular bobbin having long wire lengths normal to the external magnetic field, and short wire lengths parallel to the external field, may be utilized in combination with a small diameter shielding cylinder as set forth in more detail below.

In accordance with these and other objects which will become apparent hereinafter, the invention will now be described with particular reference to the accompanying drawings.

DETAILED DESCRIPTION OF THE PREFERRED EMBODIMENT

Figure 1:
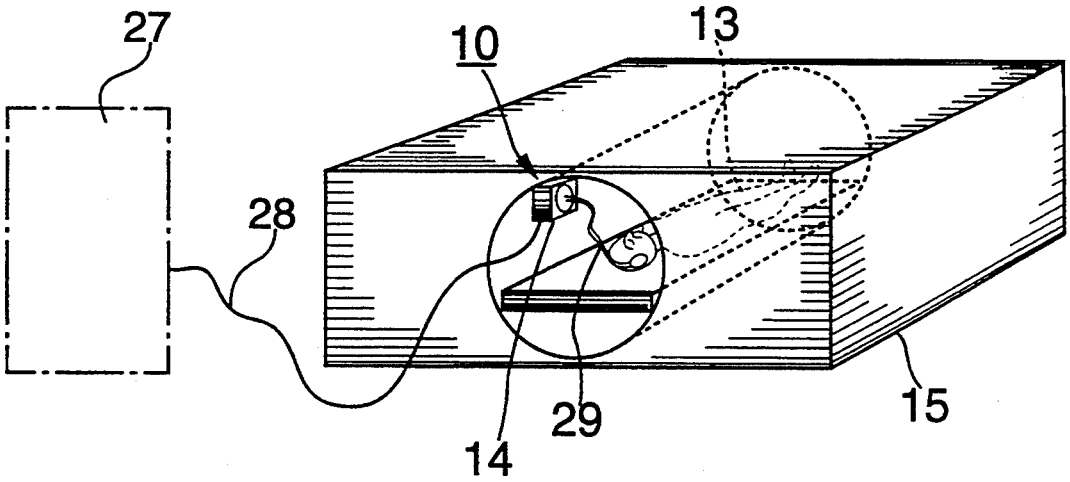
FIG. 1 is an isometric view of a loudspeaker for use with an MR Machine, wherein sound is transported to a patient therein through wave guide tubes.

With reference to FIG. 1, there is depicted an electrodynamic loudspeaker generally characterized by the reference numeral 10, which may be operated in an external magnetic field, Bext. In one particular application for loudspeaker 10, it is adapted to be placed proximal to an MR apparatus 15 or other device which generates an external magnetic field, Bext. In this manner, communication and/or music may be provided to patient 13.

Figure 2:
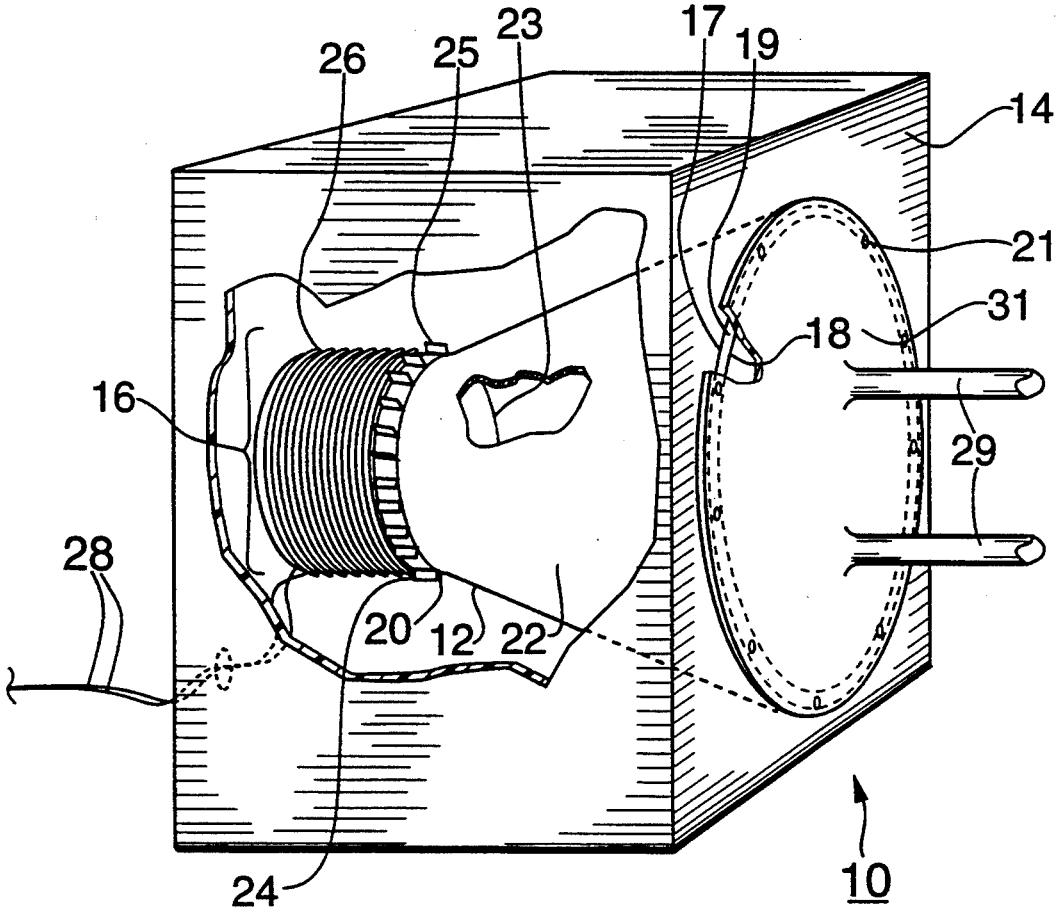
FIG. 2 is an isometric view of the loudspeaker in a rectangular frame with an attached cover and wave guide tubes.
Figure 3:
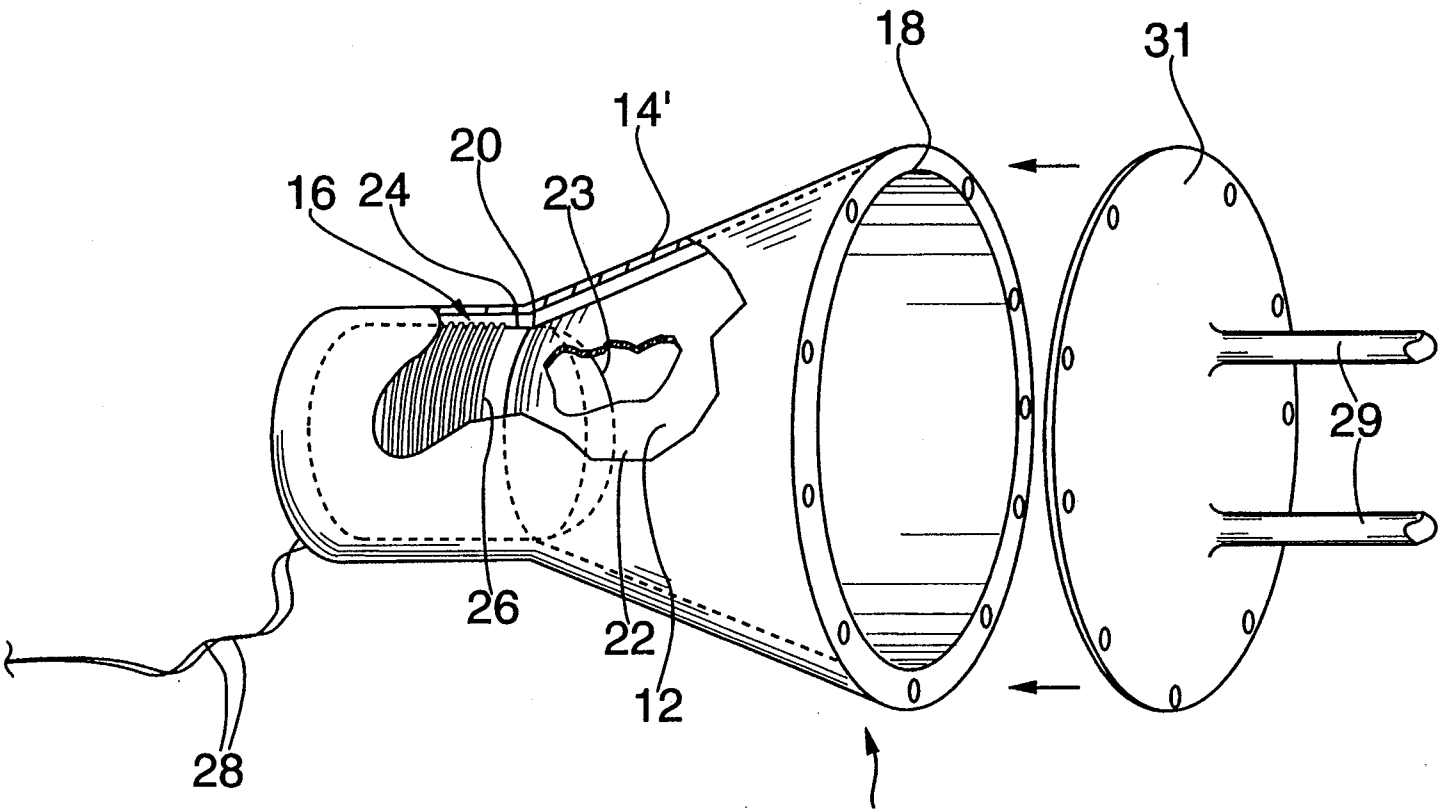
FIG. 3 is an isometric view thereof in an alternative frame with the wave guide tube cover removed.

Referring now to a first embodiment, as shown in FIG. 2, loudspeaker 10 includes diaphragm 12 defined by a first end 18 rigidly attached to frame 14 by suspension elements 19, second end 20 rigidly attached to conductor 16, and a frustum shaped intermediate portion 22. Suspension elements 19 may include a peripheral flange 17 integral with diaphragm 12 and attached to frame 14 by a plurality of fasteners 21 or the like. FIG. 3 shows an alternative embodiment of loudspeaker 10 in which frame 14' has a shape matching that of diaphragm 12 and conductor 16. In both embodiments, cap 23 extends across second end 20 of loudspeaker 10.

Diaphragm 12 is fabricated from conventional materials as is well known in the art of speaker design. To promote interaction with the external magnetic field, Bext, frame 14 is fabricated from non-magnetic material which permits the external magnetic field to pass through the housing walls and interact with the current applied to conductor 16. Since end 18 of diaphragm 12 remains fixed at all times relative to frame 14, when end 20 is biased due to the interaction of the external magnetic field, Bext, with conductor 16, frustum portion 22 dynamically deforms, creating an audible pressure wave in accordance with known principles of physics.

Conductor 16 includes bobbin 24 rigidly attached to end 20 of diaphragm 12, and a plurality of coil windings 26 circumferentially wound around the periphery of bobbin 24. To improve heat dissipation, fins 25 may be associated with bobbin 24 (for clarity, shown in FIG. 2 only). Coil windings 26 communicate through leads 28 with an external amplification source 27, as shown schematically in FIG. 1. Current is applied to coil windings 26 at varying amplitude and frequency combinations. The external magnetic field, Bext, interacts with electrified coil windings 26 which generates a resultant force on end 20 of diaphragm 12 through conductor 16, causing oscillation in proportion to the applied current amplitude and frequency. Since external magnetic field Bext, may be ascertained as a known quantity, coil parameters such as number of windings and physical sizing may be calculated to provide the desired amplitude and frequency response. Frame 14 may also include a cover 31 having a pair of attached, elongated pneumatic wave guide tubes 29 to transfer sounds directly to the patient through headphones, or frame 14 may be strategically located in the vicinity of the patient to communicate directly through the ambient.

Figure 4:
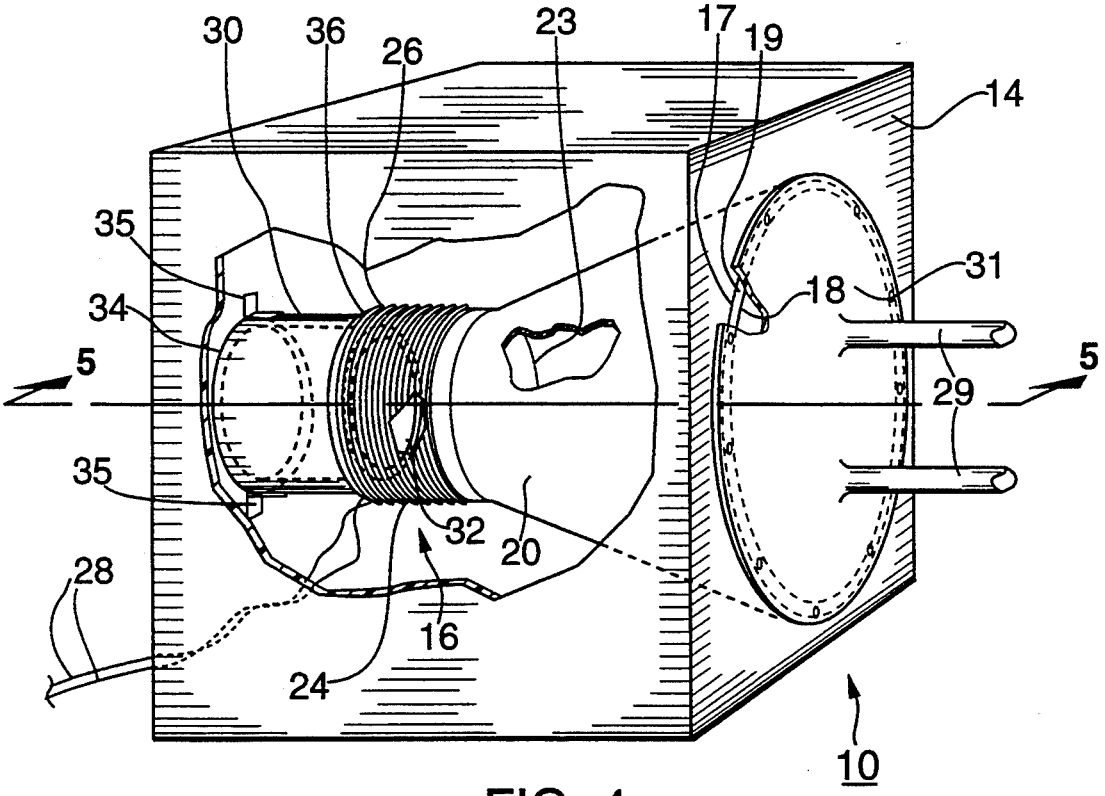
FIG. 4 is an isometric view thereof with a magnetic field diverter installed for more efficient operation.
Figure 5:
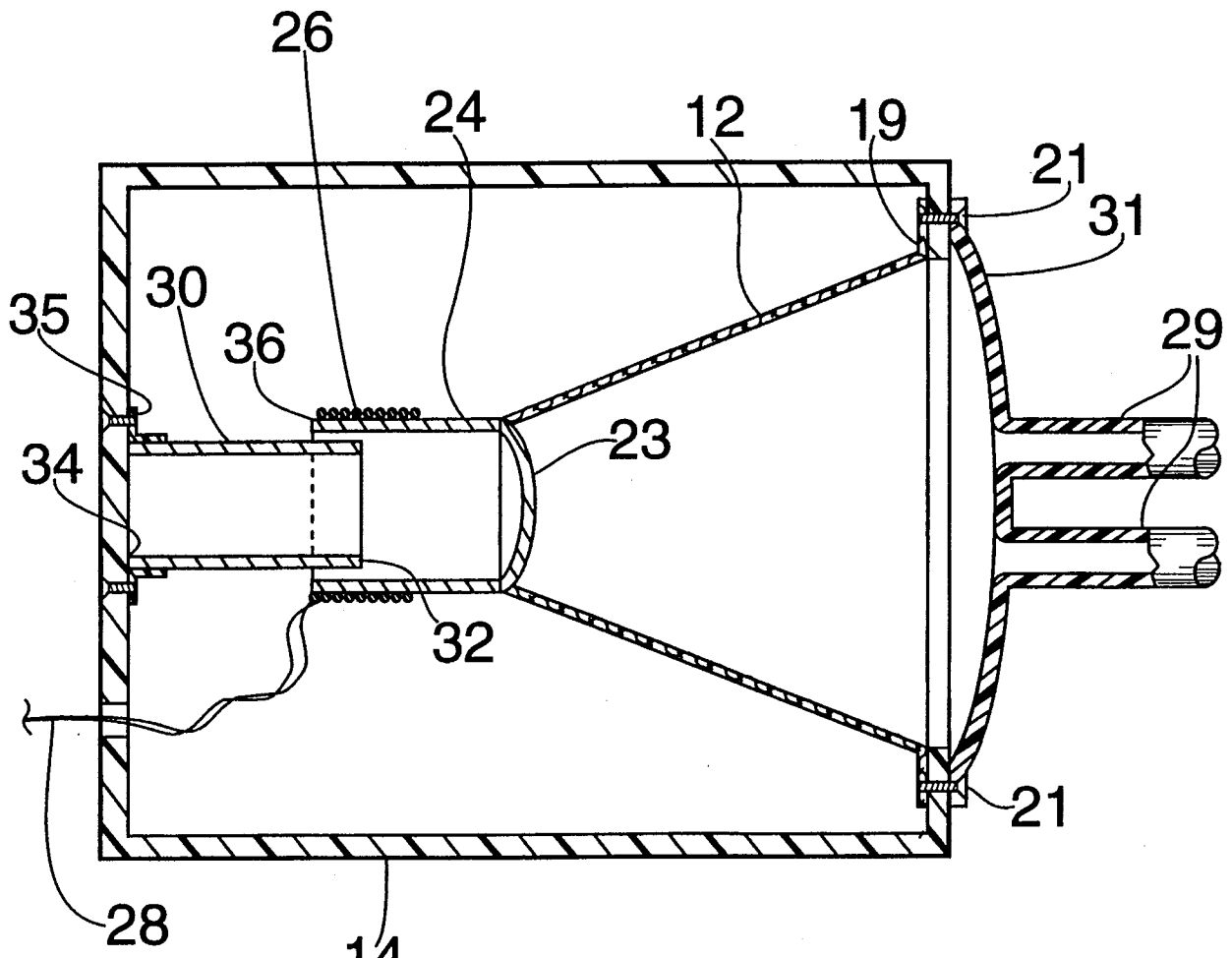
FIG. 5 is a sectional view along lines 5—5 in FIG. 4.

FIGS. 4 and 5, depict another embodiment of loudspeaker 10, including a magnetic field diverter 30 having a hollow cylindrical body fabricated from ferromagnetic material with high magnetic permeability, defined by first end 32 and second end 34, which is attached to frame 14 by bracket 35 and disposed within bobbin 24 near the aft end 36 thereof. Magnetic field diverter 30 acts as a field flux concentrator which locally reshapes the external magnetic field Bext, in the area proximal to the bobbin to provide a radial field component perpendicular to the coil windings to enhance the interaction with conductor 16. This maintains proper field orientation, even when loudspeaker 10 is rotated at varying angles of incidence to external magnetic field, Bext. Utilization of diverters with different shapes and sizes and/or different relative positions between diverter 30 and bobbin 24 allows calibration of the field interaction for optimum performance. In an external magnetic field of less than 0.1 Tesla, excellent results have been achieved when magnetic field diverter 30 is approximately 2 inches in length with a nominal wall thickness of approximately 0.030 inches. It is to be understood, however, that alternative field diverter configurations can achieve equivalent results when operating in conjunction with differing field strengths without departing from the scope of the invention.

Figure 6:
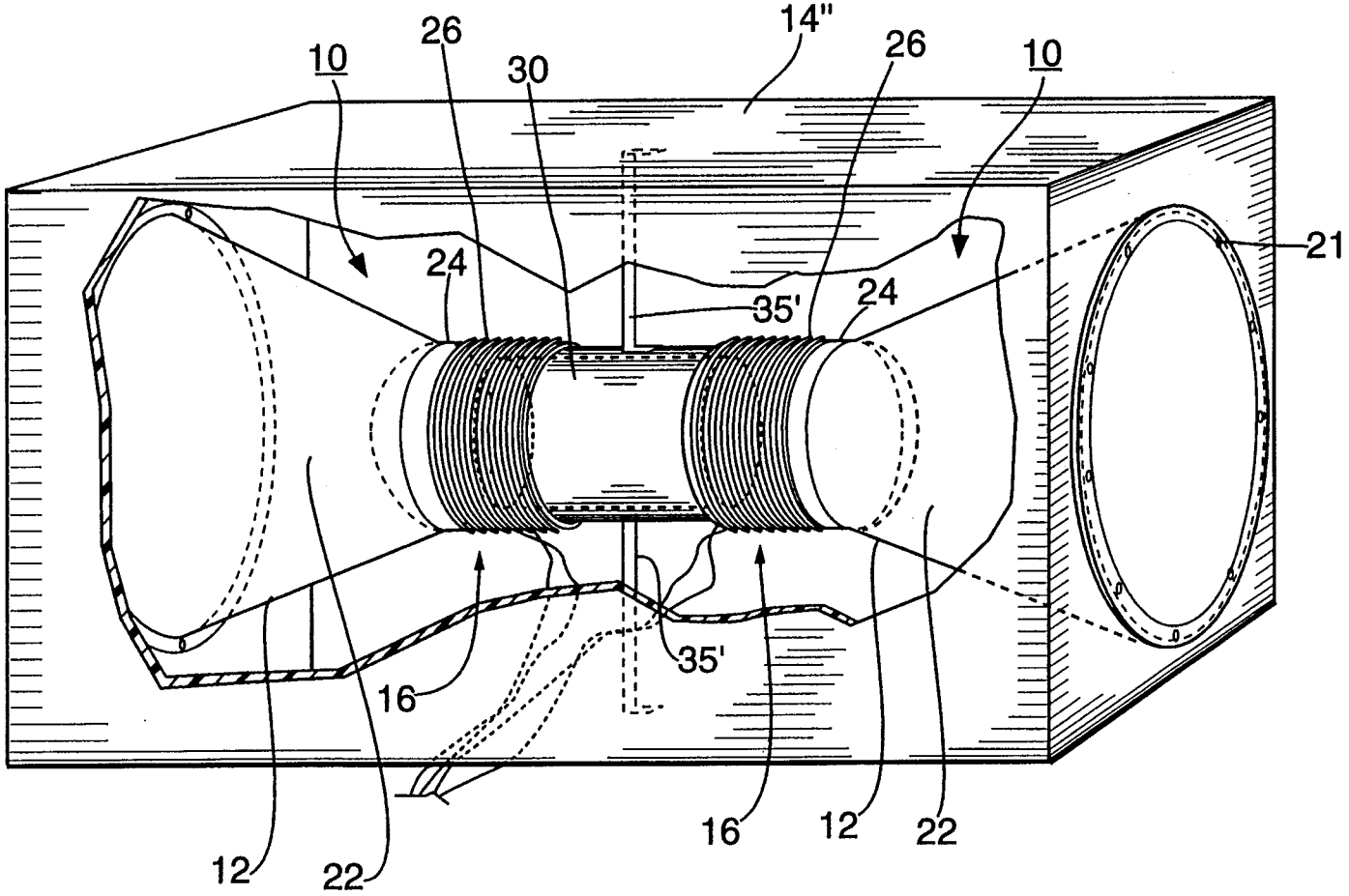
FIG. 6 is an isometric view of another embodiment wherein a pair of diametrically opposed diaphragms are attached to a frame.

FIG. 6 depicts an alternative embodiment of loudspeaker 10, wherein a pair of diaphragms 12 are diametrically opposed within, and attached to, frame 14''. Magnetic field diverter 30 is affixed to housing 14'' by brackets 35', and has each end thereof partially disposed within respective bobbins 24.

Figure 7:
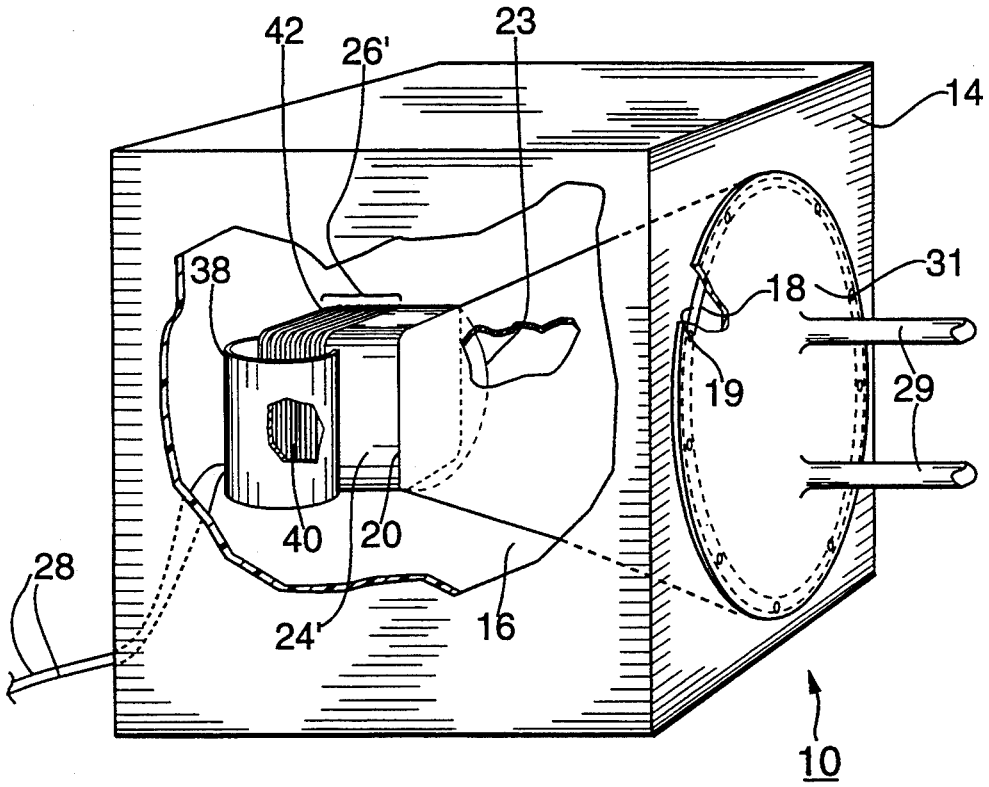
FIG. 7 is an isometric view thereof in another embodiment for operation in external fields generally perpendicular to the longitudinal extent of the diaphragm, by using a magnetic shield.

Referring now to FIG. 7, there is illustrated still another embodiment of loudspeaker 10, which is suitable for use in an external magnetic field Bext, orthogonal to the longitudinal axis of diaphragm 12 and the axis of associated conductor 16. When an unmodified loudspeaker, such as the loudspeaker shown in FIG. 2, is placed within such a field, equal and opposite forces may be produced which result in a net axial force of zero and no displacement of end 20 of diaphragm 12. To remedy this potential problem, a magnetic shield 38 is provided. Shield 38 can be of different shapes depending upon the arrangement of conductor 16. In one embodiment, the combination of a rectangular bobbin 24' having coil windings 26' with long wire lengths 40 normal to external magnetic field Bext, and short wire lengths 42 parallel thereto, in conjunction with a small diameter shield 38, has been demonstrated to provide excellent results.

All of the embodiments of the loudspeaker described herein are suitable for use with an external magnetic field, and in particular, with MR equipment. By utilizing this field to operate a speaker, good frequency response is provided, and speaker damage and the potential for accidents due to displacement of the speaker assembly within the external field at high velocity is eliminated. Since most MR devices use only a few types of magnets with each type having similar field strengths and distributions, speaker parameters such as diaphragm size, voice coil size and orientation, and power required are fairly consistent, allowing for standardization and cost effectiveness in the manufacturing process.

The present invention has been shown and described in what is considered to be the most practical and preferred embodiments. It is to be understood, however, that departures may be made therefrom and that obvious modifications will be implemented by a person skilled in the art.

We claim:

1. An electrodynamic loudspeaker for use in the proximity of an apparatus which generates a magnetic field external to said electrodynamic loudspeaker where said magnetic field is the only magnetic field which drives said electrodynamic loudspeaker, comprising:

an acoustic diaphragm having a fixed first end, a second end moveable relative to said first end, and a conductor operably connected to said second end for receiving electrical signals input thereto, said conductor comprising a bobbin and a plurality of electrically conductive windings surrounding said bobbin, said conductor being responsive when placed within said external magnetic field to said magnetic field and said electrical signals to cause said second end of said acoustic diaphragm to move relative to said first end to produce audible sounds.

2. The electrodynamic loudspeaker as recited in claim 1, wherein said bobbin further comprises a heat sink to improve heat dissipation.

3. The electrodynamic loudspeaker as recited in claim 1, further comprising a speaker frame for attaching said acoustic diaphragm at said first end thereof, and a magnetic field diverter positioned proximal to said conductor, for locally reshaping the field distribution of said external magnetic field.

4. The electrodynamic loudspeaker as recited in claim 3, wherein said magnetic field diverter is a cylindrical tube that is partially disposed within said conductor.

5. The electrodynamic loudspeaker as recited in claim 4, wherein said tube is hollow and has a wall thickness of 0.030 inches or less.

6. An electrodynamic loudspeaker system comprising a pair of electrodynamic loudspeakers as recited in claim 3, and a magnetic field diverter attached to said frame proximal to said conductors of said loudspeakers.

7. The electrodynamic loudspeaker as recited in claim 1, further comprising shielding means for locally shielding one portion of said windings from interacting with said external magnetic field to facilitate speaker operation.

8. A system for permitting a patient undergoing an examination in a magnetic resonance apparatus to hear audible sounds, comprising:

said magnetic resonance apparatus which generates a magnetic field external to an electrodynamic loudspeaker; and said electrodynamic loudspeaker for producing audible sounds responsive to said magnetic field and positioned relative to said magnetic resonance apparatus and a patient undergoing examination in the magnetic resonance apparatus to permit the patient to hear such audible sounds, said magnetic field being the only magnetic field which drives said electrodynamic loudspeaker, said electrodynamic loudspeaker comprising:

a speaker frame fabricated from non-magnetic material;

an acoustic diaphragm having a first end affixed to said speaker frame, and a second end moveable in relation to said first end, said second end having a bobbin affixed thereto and a plurality of windings surrounding said electrical signals, said windings being responsive when in said magnetic field to said magnetic field and said electrical signals to cause said second end of said acoustic diaphragm to move relative to said first end to produce audible sounds.

9. The system recited in claim 8, wherein said electrodynamic loudspeaker further comprises a magnetic field diverter positioned proximal to said bobbin for locally reshaping the field distribution of said magnetic field.

10. An electrodynamic loudspeaker for use in the proximity of an apparatus which generates a magnetic field external to said electrodynamic loudspeaker where said magnetic field is the only magnetic field which drives said electrodynamic loudspeaker, comprising:

a speaker frame fabricated from non-magnetic material; and an acoustic diaphragm having a first end affixed to said speaker frame, and a second end moveable relative to said first end, said second end having a bobbin affixed thereto and a plurality of windings surrounding said bobbin for receiving electrical signals;

said windings being responsive when placed within said external magnetic field to said magnetic field and said electrical signals to cause said second end of said acoustic diaphragm to move relative to said first end to produce audible sounds.

11. The electrodynamic loudspeaker as recited in claim 10, wherein said external magnetic field is generated by a magnetic resonance apparatus.

12. The electrodynamic loudspeaker as recited in claim 10, further comprising a magnetic field diverter attached to said frame proximal to said conductor, for locally reshaping the field distribution of said external magnetic field.

13. The electrodynamic loudspeaker as recited in claim 10, further comprising shielding means for locally shielding one portion of said windings from interacting with said external magnetic field to facilitate speaker operation.

* * * * *